US009382682B2

(12) United States Patent
Doleshal

(10) Patent No.: US 9,382,682 B2
(45) Date of Patent: Jul. 5, 2016

(54) PILE CLEANER APPARATUS

(71) Applicant: Donald L. Doleshal, Driftwood, TX (US)

(72) Inventor: Donald L. Doleshal, Driftwood, TX (US)

( * ) Notice: Subject to any disclaimer, the term of this patent is extended or adjusted under 35 U.S.C. 154(b) by 58 days.

(21) Appl. No.: 14/164,094

(22) Filed: Jan. 24, 2014

(65) Prior Publication Data

US 2014/0158171 A1 Jun. 12, 2014

(51) Int. Cl.

| | |
|---|---|
| ***E02B 17/00*** | (2006.01) |
| ***B08B 3/02*** | (2006.01) |
| *B08B 9/02* | (2006.01) |
| *B08B 13/00* | (2006.01) |

(52) U.S. Cl.

CPC ..... *E02B 17/0034* (2013.01); *B08B 3/024* (2013.01); *B08B 9/021* (2013.01); *B08B 13/00* (2013.01)

(58) Field of Classification Search

None

See application file for complete search history.

(56) References Cited

U.S. PATENT DOCUMENTS

| | | | | |
|---|---|---|---|---|
| 1,134,881 | A | 4/1915 | Lockwood | |
| 1,266,051 | A | 5/1918 | Reynolds | |
| 1,680,372 | A | 8/1928 | Fenn | |
| 2,960,706 | A | 11/1960 | Dunham | |
| 3,734,048 | A | 5/1973 | Michaelsen | |
| 4,895,205 | A | 1/1990 | Thompson et al. | |
| 5,040,923 | A | 8/1991 | Do | |
| 5,069,234 | A | 12/1991 | Nielsen | |
| 5,136,969 | A | 8/1992 | Chapman | |
| 5,361,791 | A * | 11/1994 | Chapman | B08B 9/023 134/122 R |
| 5,458,683 | A * | 10/1995 | Taylor | B08B 9/023 118/307 |
| 5,520,734 | A | 5/1996 | Taylor et al. | |
| 5,615,696 | A * | 4/1997 | Lawler | 134/104.2 |
| 5,765,968 | A | 6/1998 | Lee | |
| 6,023,807 | A | 2/2000 | Beissner | |
| 6,371,696 | B1 * | 4/2002 | Eathorne | 405/211 |
| 7,442,256 | B2 | 10/2008 | Sela et al. | |
| 8,465,228 | B2 | 6/2013 | Doleshal | |
| 2004/0069331 | A1 * | 4/2004 | Garman et al. | 134/167 C |
| 2006/0042659 | A1 * | 3/2006 | Fernandez et al. | 134/22.1 |

OTHER PUBLICATIONS

StoneAge Waterjet Tools drawing of "Assy. Piling Cleaner" dated Jul. 3, 2006, but not confirmed, attached. Drawing seems to have vanished from www.stoneagetools.com.

* cited by examiner

*Primary Examiner* — Michael Barr
*Assistant Examiner* — Cristi Tate-Sims
(74) *Attorney, Agent, or Firm* — Kenneth W. Iles

(57) ABSTRACT

A truss cage formed of two symmetrical halves is fastened together around a pile. Traction motors having caterpillar treads oriented for vertical movement are pressed against the pile by springs. A trolley ride along the tracks formed by the truss cage on the outside of the cage and carries one or more water jets or other cleaning tools. The trolley oscillates along the outside of the truss cage as the water jet sprays the pile with high pressure water. The traction motors carry the entire apparatus up and down the pile. The entire pile can thus be cleaned of marine debris.

7 Claims, 5 Drawing Sheets

PILE CLEANER APPARATUS

CROSS-REFERENCE TO RELATED APPLICATIONS

Not Applicable.

STATEMENT REGARDING FEDERALLY SPONSORED RESEARCH OR DEVELOPMENT

Not applicable.

SEQUENCE LISTING

Not applicable

BACKGROUND OF THE INVENTION

The present invention is related to an apparatus and process for automatically cleaning piles or the like.

DESCRIPTION OF THE RELATED ART INCLUDING INFORMATION DISCLOSED UNDER 37 C.F.R. 1.97 and 1.98

As used herein, a "pile" is a heavy beam or post, typically driven vertically into the bed of the river, soft ground, etc., to support the foundations of a superstructure. More particularly, the term pile refers to such a post that is driven into the ground beneath water, typically ocean water near a shore where a portion of the pile will be submerged in the earth below the water and a portion will be above the water to support a dock or the like. Typically, a dock or the like is supported by a large number of piles. In the splash zone, that is, the zone about six to eight feet below the normal placid water level and above that level to the point that wave action touches the piles, marine action causes significant accumulation of marine debris, such as marine animals and plants, corrosion, erosion and the like. This debris must be removed before any structural inspection or remediation such as jacketing or the like can be undertaken.

A common prior art approach is to send divers into the water with high powered water jets to blast marine debris from the piles. This approach is dangerous and largely ineffective. Most commonly, the water around the piles is turbulent and murky—so murky that a diver cannot see more than about a foot and a half in front of him. The currents make it hard for the diver to stay in one place, particularly after turning on the high powered water jet which may utilize water under 1500 pounds per square inch pressure, creating about 150 pounds of backward thrust which naturally tends to push the diver backward. The work is arduous and the water is often very cold. Consequently, work shifts are necessarily brief. Because it is disorienting to be underwater and unable to see, a diver can lose track of his position relative to the pile and the position of the water jet and the direction of the water being expelled from it. This leads to two serious disadvantages. First, piles cleaned by this method are rarely cleaned well. Second, it is not uncommon for a diver to injure himself, even severing fingers or toes by inadvertently pointing the water jet at his own body.

Inventors have patented devices that endeavor to address these problems, some of which are discussed below.

U.S. Pat. No. 5,765,968, issued to Lee on Jun. 16, 1998, discloses an Apparatus for Eliminating and Preventing Marine Growth on Offshore Structures, comprising a ring that is placed about a circular cross section pile and is closed by a clasp or link, and a number of rollers about the ring that contact the pile and allow the ring to rotate about the ring. The ring has two semi-circular segments. A number of sharp blades are attached to the outside of the ring to catch currents and cause the ring 1 to rotate or oscillate and rock back and forth randomly. A number of these rings can be connected together, one below the other by vertical connecting members and can be maintained in a desired position by a number of floats fixed to an upper ring. A number of brushes, which can be made in a variety of shapes and sizes, scrap the pile as the rings are moved about by wave action.

U.S. Pat. No. 5,040,923, issued to Do on Aug. 20, 1991, discloses an Apparatus for the Prevention of Marine Growth of Offshore Structures comprising a ring composed of straight-line segments connected together, which has brush segments to scrap the pile as currents move the ring. Only water waves and currents provide power to the apparatus. A number of these rings can be connected together vertically by the vertical tubular connectors. In construction and operation it is very similar to Lee '968 above. Both this apparatus and the apparatus of Lee '968, above, depend entirely on water currents for motion and, therefore, scrubbing action on the pile, which will be unpredictable in intensity and duration. Further the force on brushes will also be unpredictable and likely insufficient to clean debris from the pile. The time required to clean a pile will be unpredictable and will vary, as to the same pile, from day to day.

Brushes are also utilized in U.S. Pat. No. 2,960,706 for a Pile Cleaning and Treatment Device, issued to Dunham on Nov. 22, 1960, which has powered brushes and includes nozzles mounted inside drum for spraying creosote or other toxic coating material onto the pile, and U.S. Pat. No. 1,134,881 for a Pile Protecting Device, issued to Lockwood on Apr. 6, 1915, which includes a heavy circular ring with brushes projecting toward the center of the circle and which is placed about a pile, dropping by the force of gravity and simultaneously brushing the pile. A related device that uses a loose chain placed around the pile at its base and connected to floats that rise through the water and thereby drag the chain along the side walls of the pile is disclosed in U.S. Pat. No. 1,266,051 for a Pile Cleaner and Protector, issued to Reynolds on May 14, 1918.

Systems that utilize wave action to move brushes do not provide predictable cleaning action and results and that can be controlled as to the force of the cleaning action and the time used for cleaning a pile. These systems also cannot operate above the water line, but corrosion, marine life encrustation and the like also occur in the splash zone above the normal waterline. Therefore, there is a need for an automatic pile cleaner that thoroughly cleans piles; that can be controlled by an operator and that provides predictable cleaning times and that can clean piles above the normal waterline.

U.S. Pat. No. 8,475,228 B2, issued on Jun. 18, 2013 to Doleshal, addresses some of these concerns by providing a hoist to raise and lower a washing ring that carries water jets to spray the pile, moving the washing ring and jets up and down a pile with a cable and pulley system. Maintaining the washing ring in the desired horizontal position is difficult due in part to the lack of contact of the washing ring with the pile, i.e., the washing ring hangs freely from the supporting cables. Water currents, differences in thrust among the water jets and so forth can move the washing ring out of its desired horizontal position and out of the desired position concentric with the pile, possibly resulting in uneven cleaning and difficulty in controlling the apparatus.

BRIEF SUMMARY OF THE INVENTION

Accordingly, it is a primary object of the present invention to provide a pile cleaner apparatus that thoroughly cleans piles.

It is another object of the present invention to provide a pile cleaner apparatus that can be controlled as to the force of the cleaning action and the time used for cleaning a pile.

It is another object of the present invention to provide a pile cleaner apparatus that maintains a stable position between the pile and the cleaning elements.

It is another object of the present invention to provide a pile cleaner apparatus that can clean piles above the normal waterline.

These and other objects of the present invention are achieved by providing an automatic apparatus for gripping the pile and cleaning it by high-pressure water jetting from a number of high-pressure water jets mounted on a trolley apparatus that rotates about a spheroidal shaped truss system that is firmly connected to the pile by one or more traction motors mounted onto the truss system and having caterpillar treads that bear against the pile due to spring compression tension. Other cleaning techniques, such as rotating brushes, cavitation jets and the like may also be employed by the pile cleaner apparatus. The apparatus cleans a small area of a pile and then automatically moves downward or upward along the pile a set distance by actuating the caterpillar treads on the traction motors, all the while cleaning the pile with the high-pressure water spray. This sequence is repeated until the entire pile is cleaned.

Conventional flotation devices can be attached to the truss to provide a neutral buoyancy apparatus, thereby reducing the force needed to raise or to lower the pile cleaning apparatus along a pile.

The electrically driven traction motors can be controlled manually by an operator using a joy stick or the like, or may be controlled by computer software, which may facilitate the synchronization of movement created by different traction motors.

Other objects and advantages of the present invention will become apparent from the following description taken in connection with the accompanying drawing, wherein is set forth by way of illustration and example, the preferred embodiment of the present invention and the best mode currently known to the inventor for carrying out his invention.

DETAILED DESCRIPTION OF THE INVENTION

Figure 1:
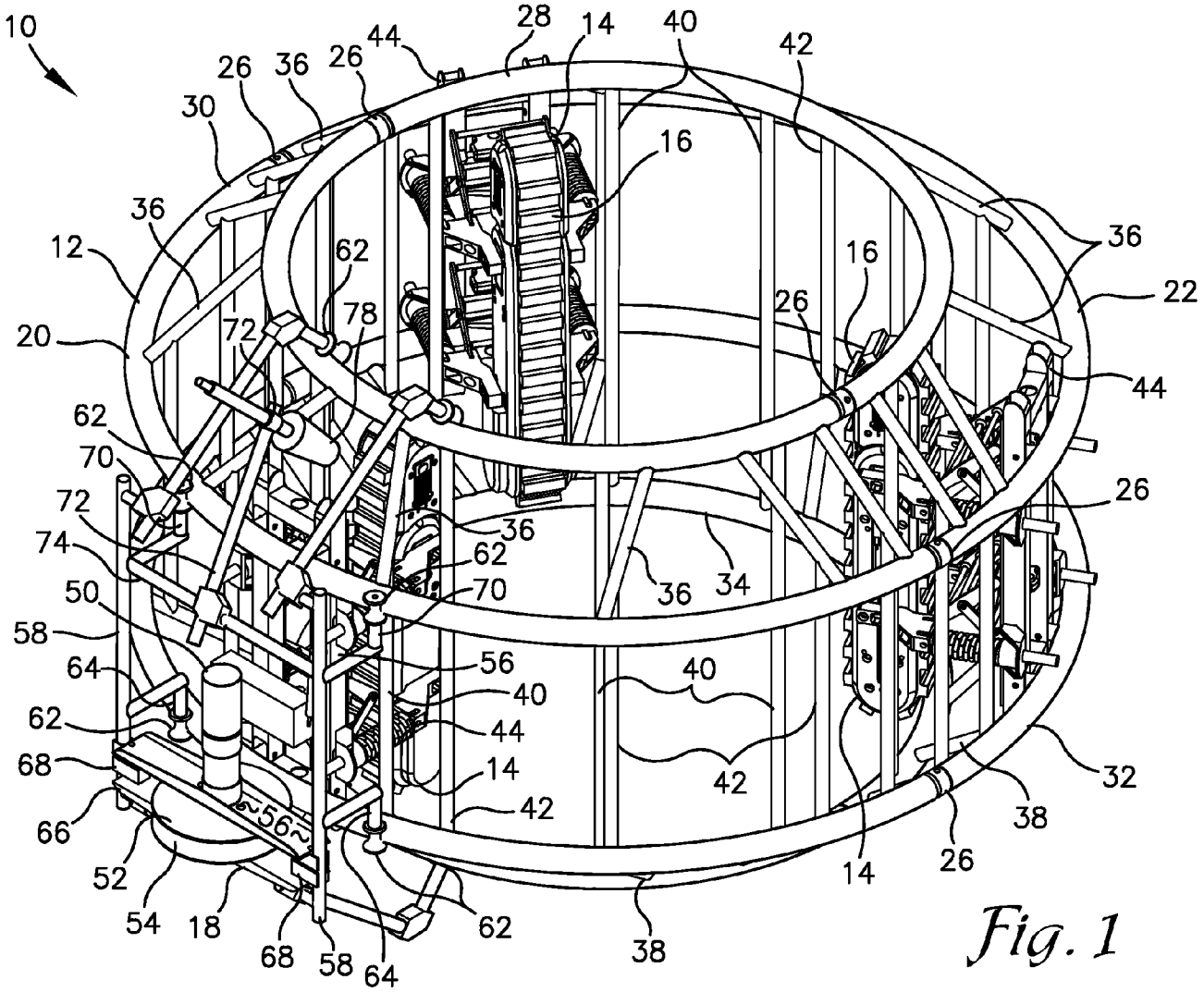
FIG. 1 is an isometric view, looking down, of a pile cleaner apparatus according to the present invention

Referring to FIG. 1, a pile cleaner apparatus 10 according to the present invention includes three principal subassemblies, which are: (1) a truss cage 12 for providing a framework around a portion of a pile; (2) one or more electrically operated traction motors 14, each having a pair of spaced parallel caterpillar traction treads 16, with the traction motors 14, which are can be driven either forward or backward, or in this case, up or down and are preferably actuated by electric motors inside the traction motors 14, fastened to an interior side of the truss cage 12 and positioned so that the traction treads bear against the pile; and (3) a trolley 18 that is fastened to the outside of the truss cage by a number of grooved wheels; that moves along the perimeter of the cage truss as if on a track, that is driven by an air motor that engages one ring of the truss cage and that carries at least one pile cleaning device, such as a water jet. In use, the truss cage 12 moves up and down the pile, but does not rotate. The traction treads 16 move and the trolley 18 moves relative to the truss cage 12.

Still referring to FIG. 1, the truss cage 12 includes two symmetrical, i.e., mirror image, halves, a left side half 20 and a right side half 22, which are separately placed about the pile 24 (not shown in FIG. 1, but runs up through the center of the pile cleaner apparatus 10; see FIG. 2) and then joined together by the spigot joints 26, or other suitable joint, in each of the ring members (from top to the bottom of the pile cleaner apparatus 10) 28, 30, 32, 34, each of which is circular and all of which are concentric. (A spigot joint, such as the spigot joints 26, is a connection between two sections of pipe or tubing in which the straight or spigot end of one tube is inserted into a flared out end of the mating tube and the joint is sealed by welding, caulking, or the like.) More than two sections can be employed in the case of a very large pile 24, such as three or more sections or more. The only limitation is that the assembled truss cage 12 must have smooth contiguous outer surfaces to provide a smooth track for the trolley 18 to ride along. The two middle ring members 30, 32 are of the same diameter, while the lower ring member 34 and the upper ring member 28 are of equal diameter, but of smaller diameter than the two middle ring members 30, 32. The ring members 28, 30, 32, 34 are held together by a suitable network of struts. From the top of the truss cage 12 to the bottom of the truss cage 12 the order of the ring members is first the top ring member 28, then the second ring member 30, then the third ring member 32 and finally the bottom ring member 34, The top ring 28 and the second ring 30 are held together by the upper angled struts 36 that link only these two truss rings. The third ring 32 and the bottom ring 34 are similarly held together by the lower angled struts 38. The structures formed by the unit of the top ring 23 and the second ring 30 and the unit formed by the third ring 32 and the bottom ring 34 are identical. These two structures are held together by the elongated vertical struts 40, which run from the top ring 28 to the bottom ring 34. The second and third ring members are held together by the short vertical struts 42. The numbers of and locations of struts used to hold the rings 28, 30, 32, 34 in place to form the truss cage 12 are a matter of design choice and will vary depending on the size of a particular pile cleaner apparatus and the required strength. As shown, the pile cleaner apparatus 10 is suitable for cleaning an approximately 630 cm (24 inches) pile 24, but can be fashioned for any desired size of pile 24. As shown, the pile cleaner apparatus includes about fifteen upper angled struts 36 and about fifteen lower angled struts 38 and about ten elongated vertical struts 40 and about x short vertical struts, not all of which are shown (in order to show the trolley 18 and other features more clearly).

Still referring to FIG. 1, the truss cage 12 is made of stainless steel tubing that is welded together. Stainless steel provides a good blend of strength and weight, with the truss cage 12 as described weighing about 70 kg. (150 lbs.)(i.e., without the trolley 18). Further it is corrosion resistant. Alternatively the truss cage can be made of anodized aluminum, or fiberglass, carbon fiber, injection molded plastic or other suitable material. It can be made in different sizes for different sized piles and to handle different thrust loads. One or more buoyancy packs, well known in the art, such as lift bags, are inserted into the spaces between the elongated vertical struts 40 to provide zero buoyancy and attached by suitable fasteners. Because each of the ring members 28, 30, 32, 34 serves as a track for the trolley 18 to move along and because the tube ends that make up the spigot joints 26 must line up precisely, manufacturing tolerances for the truss cage where the tubes align at the spigot joints 26 are quite small, preferably on the order of less than 0.028 mm (0.001 inches).

Still referring to FIG. 1, three traction motors 14 are fastened to the inside of the truss cage with their caterpillar traction treads 16 being vertically aligned and with the three traction motors 14 being spaced at 60° from one another about the diameters of the truss cage 12. The caterpillar traction treads are made of rubber or the like with deep friction ridges perpendicular to the line of travel on their surfaces, as is conventional. Alternatively, a tread as used herein means any mechanical device or means for applying a driving force to the pile 24 in order to move the pile cleaner apparatus 10 up and down the pile 24, such as individual wheels or the like. Caterpillar traction treads 16 are generally preferred because they generally provide greater traction. The traction motors 14 are conventional and find many applications in industry and the like, although certain desired performance characteristics may need to be special order, e.g., they must be waterproof to a certain desired depth of water; they must be impervious to salt water; and each must be powerful, requiring an appropriate gear speed reduction depending on the power of the traction motors 14, such as in this case a gear reduction of 1,000 to 1 or more in order to be able to lift the desired 140 kg. (300 lbs.) up a pile. The traction motors 14 are driven by 48 volt DC electricity, and draw about 5 amperes under heavy load for total maximum consumption of about 240 watts, or as required by a particular motor and application. The direction of travel and the speed of travel can be controlled, as is conventional in traction motors. The number and placement of traction motors 14 varies depending on the size of a particular pile cleaner apparatus 10 and its performance needs. For a relatively small pile cleaner apparatus 10, a single traction motor 14 may be employed, with an idler caterpillar traction tread aligned across a diameter of the truss cage 12 from it. In more demanding applications, four or more traction motors 14 may be deployed. In any case, however, the mounting of the traction motors 14 and their operation remain the same.

Still referring to FIG. 1, the caterpillar traction treads 16 must forcefully engage the pile 24, pressing the caterpillar traction treads 16 firmly against the pile 24 to hold the pile cleaner apparatus 10 in one place along the pile 24 and to generate the friction needed to move the pile cleaner apparatus 10 up and down the pile 24. Preferably, the force of the pair of caterpillar traction treads 16 of each traction motor 14 is about 140 kg. (300 lbs.). In use with the pile cleaner apparatus 10, the traction motors 14 and their caterpillar traction treads are vertical, so that their activation causes and up or down movement of the pile cleaner apparatus 10. To achieve this amount of force, each traction motor 14 is mounted on a separate traction motor suspension system 44 that pulls the caterpillar traction treads 14 away from the pile 24, releasing the caterpillar traction tread 16 from contact with the pile 24, which is necessary when installing the pile cleaner apparatus about a pile 24 and then releases the compressed Belleville springs that push the caterpillar traction treads against the pile 24, as shown and discussed in more detail below in connection with FIGS. 3-5 below. Each traction motor 14 is held onto the truss cage 12 by welding the bottom frame member 46 to the second ring member 30 and the third ring member 32 or other suitable fastening system.

Still referring to FIG. 1, the trolley 18 an assembly of rods that form a trolley 18 that moves around the outer circumference of the truss cage 12, driven by an air motor 50 that drives a grooved drive wheel 52, the groove 54 of which engages the third ring member 32 with sufficient friction to propel the trolley 18 about the outer circumference of the truss cage 12. Electric or hydraulic motors or other types of drives can be used. A base plate 56 includes a central aperture 58 that the air motor 50 passes through and is seated in, with the grooved drive wheel 52 fastened to the drive shaft of the air motor and located below the base plate 56. A pair of upright spaced apart parallel vertical struts 58 are fixed to the ends of the base plate 56. Attached to the upper ends of each of the vertical struts 58 is an upper inwardly angled roller arm 60, each terminating in a roller 62, which is shaped like a thread spool, with a wide central channel with a flange on each end, locking the rollers 62 into engagement with the top ring member 28. The rollers 62 are made of any suitable material, but an ultra-high molecular weight polyethylene machined to shape is preferred because the resulting rollers 62 have a very low coefficient of friction but are more wear resistant that steel. A pair of spaced parallel lower inwardly angled arm members 64 are fastened to a lower base plate member 66 and have distal ends that are fitted with rollers 62 that engage the bottom ring member 34. The base plate 56 and the bottom ring member 34 are parallel to each other and are maintained in their spatial relationship by being fixed to the two spacer blocks 68, with one spacer block 68 at end of the base plate members 56, 68. Four more rollers 62 are used by the trolley 18, two pressed against the each of the ring members 20, 32, each being held in place by a straight arm 70, each of which has a proximal end fixed to one of the vertical struts 58. The trolley 18 is made of carbon fiber material due to its light weight and strength. The total weight of a completed pile cleaning apparatus 10 designed to accommodate a 50 cm (24 inch) pile would weight about 114 kg, (250 lbs.). When the arms 60, 64, 70 of the trolley 18 are attached to the truss cage 12 as shown in FIG. 1, the rollers 62 along the top ring member 28 and the bottom ring member 38 are nearly on a side of their respective ring members that is opposed to the trolley 18, providing a very strong gripping action so that the trolley can easily accept loads of a few hundred kilograms of force directed away from the center of the pile 24, which may be caused by the thrust from a water jet nozzle 78 or the like. The trolley 18 can, however, be removed from the truss cage 12 very easily by picking up a few of the arms 60, 64, 70, removing them from contact with their respective truss cage members.

Still referring to FIG. 1, the trolley 18 includes a water jet mounting bracket 72, which is fastened to a top bar 74 between the two parallel spaced vertical struts 58, and which has a distal end terminating in a yoke 76 (see FIGS. 4, 5) that holds a water jet nozzle 78 or other cleaning tool or system. A typical water jet for use with the pile cleaner apparatus would operate at about 6,900 Kilo Pascals (1,000 pounds per square inch pressure) and would generate about 1,035 kilo Pascals (150 lbs.) of thrust. The use of water jets, however, may be undesirable in some applications. For example high-pressure water jets may damage epoxy coatings on piles, so it may be more desirable to use brushes for cleaning epoxy coated pile. In some cases, a cavitation jet may be preferred, particularly since one-half of thrust generated by a cavitation jet is directed rearward of the cavitation jet and one-half is directed forward of the cavitation jet, resulting in neutral effective thrust. This arrangement allows for cleaning of the pile above the truss cage 12, but an identical bracket 72 can be mounted on the bottom of the trolley 18 for cleaning of a pile portion that is below the truss cage 12. Any number of trolleys 18 may be mounted on any particular cage truss 12, subject only to space limitations and economics, but for many large piles using more than one trolley 18 will allow for quicker cleaning. Multiple trolleys 18 on one truss cage can be controlled separately or may be coordinated by an operator, by computer software, etc. Alternatively, stops may be placed (temporarily or permanently) at desired positions along each of the ring members 28, 30, 32, 34 to prevent multiple trolleys 18 operating on one truss cage 12 from running into each other. A single trolley 18 is free to move anywhere along the outer circumference of the truss cage 12.

Figure 2:
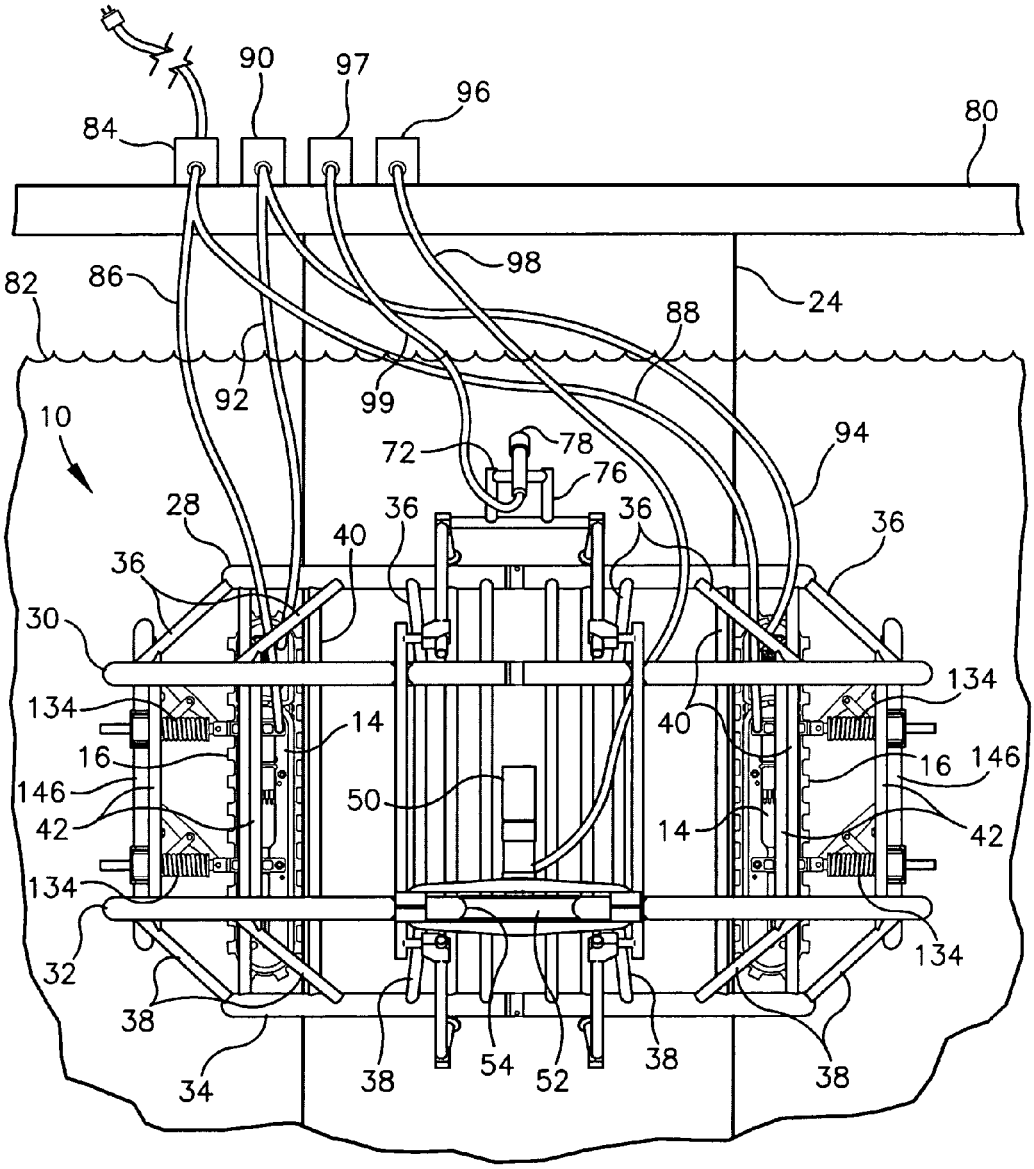
FIG. 2 is a side view of the pile cleaner apparatus of the FIG. 1.

Referring to FIG. 2, a pier 80 rests on the pile 24 (and other piles) and is used to support control equipment in a dry location above the water line 82. A source of electricity 84, such as batteries or rectified DC current derived from conventional AC sources or the like, supplies electricity to each of the traction motors 14 through the left hand side electrical cable 86 and to the right side traction motor 14 thought the right side electrical cable 88. A controller apparatus 90 delivers appropriate electrical supply and control signals, which may include joystick controls, computer software control signal, and the like, which are carried to each traction motor 14 via a left hand side cable 92 and a right hand side cable 94. An air compressor and controller 96 is connected to the air motor 50 by an air hose and control cable 98, which provides the compressed air to drive the air motor 50 and to control its direction of rotation and its speed of rotation. These controls are coordinated with the traction motor 14 controls such that the outer circumference of the pile 24 at a particular horizontal line is completely cleaned during the time that it takes the traction motors 14 to move the water jet from the water jet nozzle 78 to a location out of the prior effective spray pattern, thereby assuring that the entire surface of the pile is cleaned. The supply of electricity 84, the controller apparatus 90 and the air compressor and controller 96 need to be kept out of the water and so can be located on a pier 80, in a boat, in a submarine, or the like. A source of pressurized water 97 is connected to the water jet 78 by the hose 99. The cables 86, 88, 92, 94, 98, 99 may be combined into one cable with different tubes in it and are shown wholly separate for clarity. The cables 86, 88, 92, 94, 95, 98, 99 must be long enough so that they can reach the depth to which the pile 24 is to be cleaned, usually not more than 100 m (300 ft.) and can be wound about a winch or drum and deployed at greater lengths as the pile cleaner apparatus is moved down the pile 24 and wound up again as the pile cleaner apparatus 10 is raised toward the surface of the water.

Figure 3:
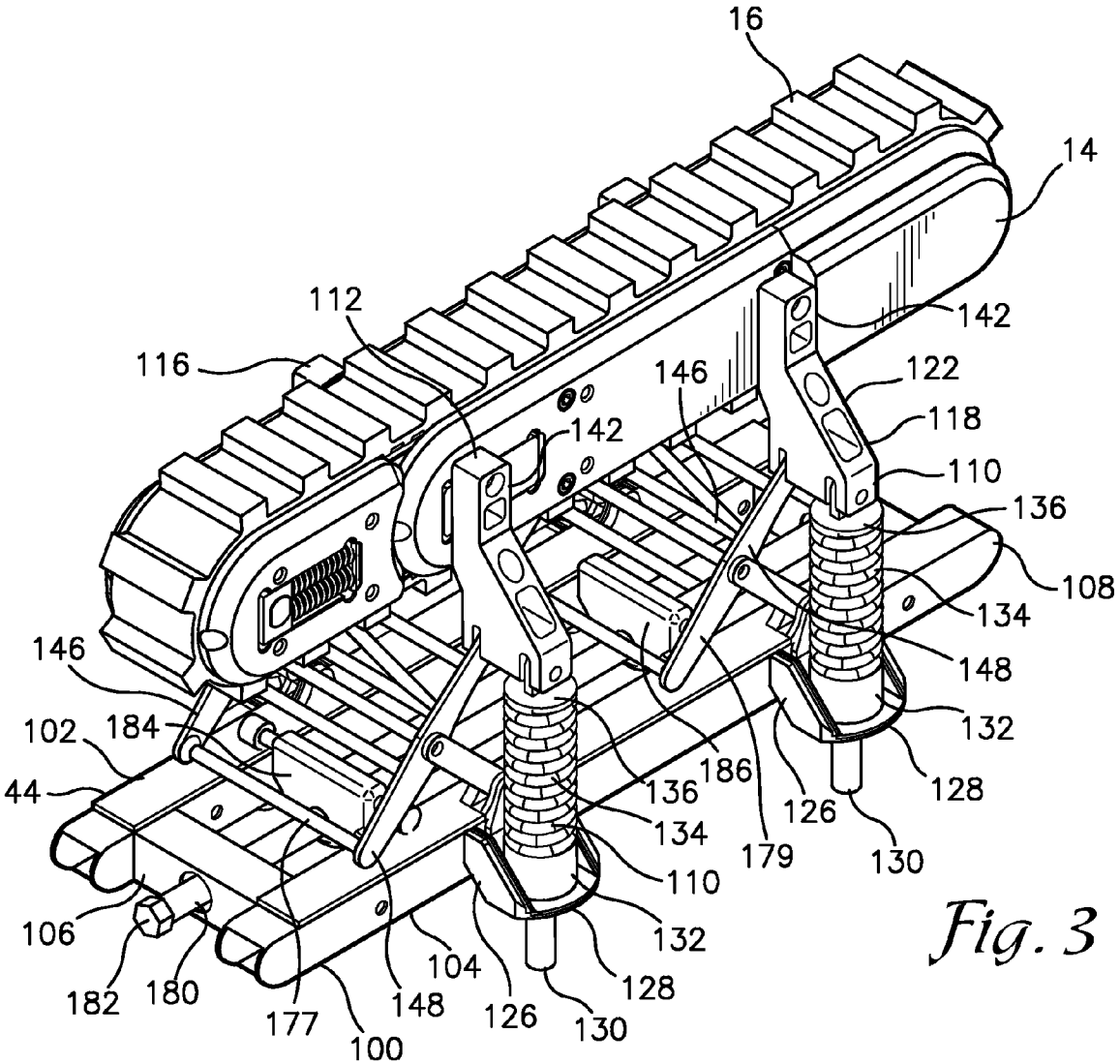
FIG. 3 an isometric view of a traction motor and traction motor suspension system according to the present invention.
Figure 4:
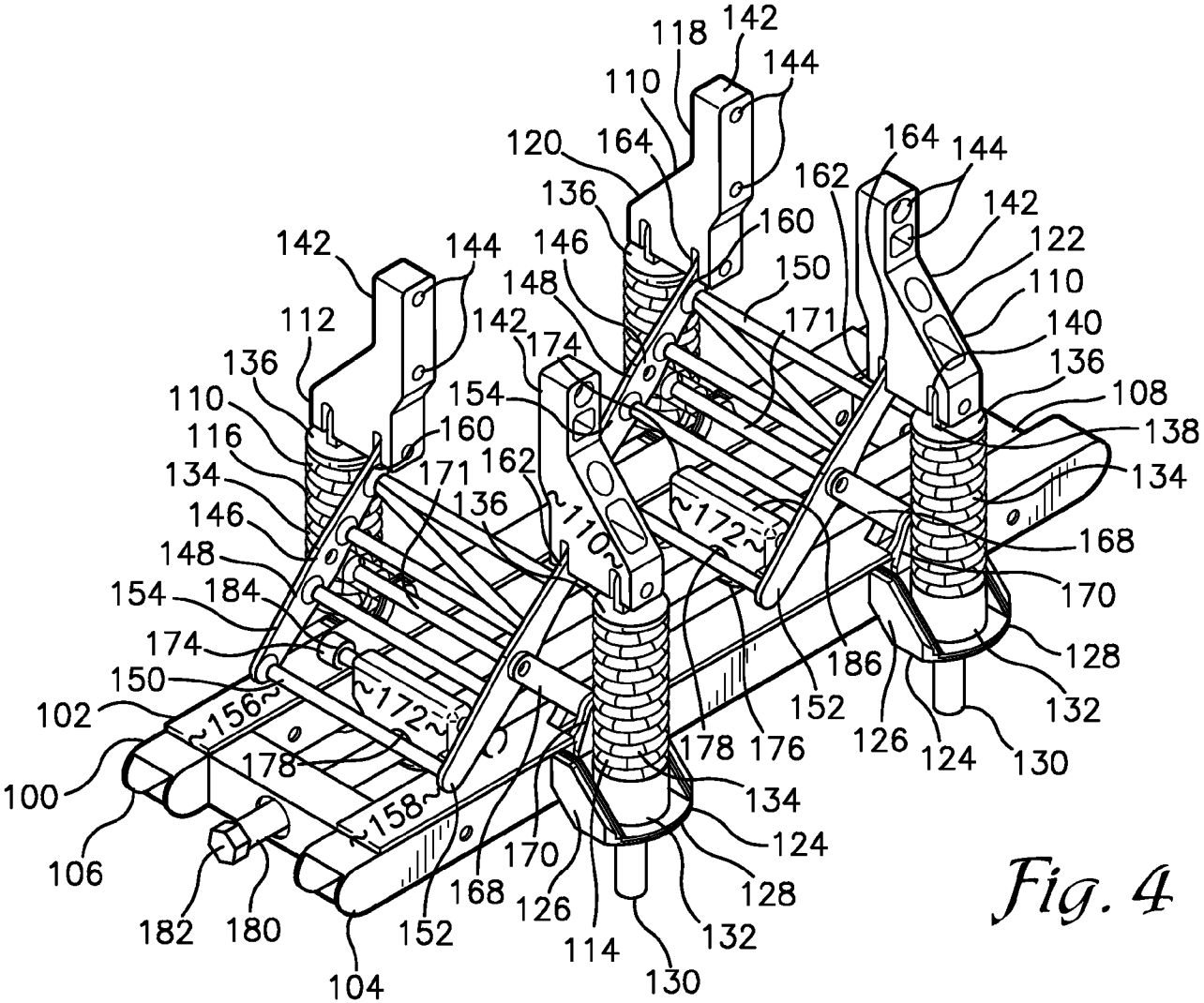
FIG. 4 is an isometric suspension and compression system of FIG. 3 shown without the traction motor.

Referring to FIGS. 3, 4 the traction motor suspension system 44 retracts the traction motor 13 away from the center of the pile 24, which is required when the pile cleaner apparatus 10 is being placed about a pile 24, that is, there must be clearance between the pile 24 and the caterpillar treads 16. When the pile cleaner apparatus 10 is to be used, naturally the caterpillar treads 16 must be in firm engagement with the pile 24 and the traction motor suspension system 44 provides this function. A frame 100 includes a left hand rail member 102 and a spaced parallel right hand rail member 104, which are connected by the front end member 106 and rear end member 108, both of which are perpendicular to the rail members 102, 104, forming a rectangular box shape with an open channel in the center. Four upstanding vertical arms 110 (as seen in FIGS. 3, 4) fastened to the rail members 102, 104 form a front traction motor mounting bracket 112, i.e., formed by the front-left vertical arm 114 and the front-right vertical arm 116, and a rear traction motor mounting bracket 118, i.e., formed by the left rear vertical arm 120 and the right rear vertical arm 122. The two arms that form a bracket 112, 118 are directly opposite each other across the width of the frame 100.

Referring specifically to FIG. 3, each vertical arm 110 includes a mounting ear 124 having a vertical portion 126 fastened to a rail member 102, 104 and a horizontal portion 128 having an aperture penetrated by a vertical rod 130 having a thick washer 132 adjacent to the horizontal portion of the mounting ear 124 on top of which is a Belleville spring washer stack 134 designed to provide about 34 kg. (75 lbs.) of uncompressed loading in each stack, for a total of about 135 kg. (300 lbs.) of force pressing each traction motor 14 into the pile 24 when the compression tension in the Belleville spring washer stack 134 is allowed to exert itself, i.e., when uncompressed, i.e., the Belleville spring washer stacks 134 push the traction motor 14 away from the *frame 100 and toward the pile 24. A top washer 136 tops the Belleville spring washer stack 134 and includes a vertical flange 138 that mates with and is sealed into a slot 140 in a bracket head 142. The bracket head 142 includes a pair of apertures 144 through which machine screws are inserted, which are screwed into mating drilled and tapped holes in the traction motor 14.

In the state shown in FIG. 4, there is nothing compressing the Belleville spring washer stack 134 except the height of the vertical rod 130 that the Belleville spring washer stack 134 is placed on. The Belleville spring washer stack 134 is compressed, in order to retract the traction motors 14 away from the pile 24, by the half-scissors jack 146 (one jack 146 for each bracket 112, 118). The half-scissors jack 146 includes a rectangular frame 148, reinforced by five cross bar members 150. The lower ends of the two jack frame rails 152, 154 ride on a low-friction strip 156, 158 on the tops of the jack rails 102, 104 and top ends 160, 162 that mate into slots 164 in the bracket heads 142, where they are fastened for pivotal movement about an axis in the bracket heads 142. One end of a jack arm 168 is pivotally connected to the middle of the length of each jack frame rail 142, 144 and the other end is pivotally connected to a vertical ear 170 fixed to the frame rails 102, 104 adjacent to a Belleville spring washer stack 134. A stabilizing rod 171 is fixed to and between each pair of jack arms 168 in each half-scissors jack 142. A jack actuating member 172 includes an axle 174 that spans the channel between the frame rails 102, 104, with its ends resting on the top surface of these members and a depending tab 176 that includes a threaded aperture 178. The jack actuating member 172 is free and not attached to the half-scissors jack 146, but is held by gravity against the frame rails 102, 104. The front end member 106 of the frame 100 includes a threaded aperture 180, which is aligned with the threaded aperture 178 in the depending tab 176 of both the front half-scissors jack 177 and the rear half-scissors jack 179. A threaded shaft 180 having a hexagonal head 182 for engagement by a wrench (not shown) or the like is threaded into the three aligned apertures and a fastener is placed on the distal end of the threaded shaft 180 beyond the depending tab 176 on rear half-half scissors jack 180, preventing the threaded shaft 180 from being unscrewed. Then rotating the threaded shaft 180 counterclockwise draws the threaded shaft outward of the front end member 106 of the frame 100, drawing along with it the front jack actuating member 184 and the rear jack actuating member 186, each of which engages and the lower ends of the front and rear jack frame rails 152, 154, thereby drawing the bottom ends of the jack frame rails 152, 154 toward the front end member 106 of the frame 100 and thereby pulling all four of the bracket heads 142 down (as viewed in FIGS. 3, 4), compressing the Belleville spring washer stacks 134 and releasing the caterpillar treads 16 of the traction motors 14 from the pile 24. Rotating the threaded shaft 180 clockwise reverses the movements of all parts and allows the Belleville spring washer stacks 134 to recompress, putting the traction treads 16 into firm contact with the pile 24. When the caterpillar traction treads 16 are as fully pressed against the pile 24 as the Belleville washer stack 134 is designed to allow, each traction motor 14 can still be moved about 2.5 cm (1 inch), i.e., suspension travel, outward from the center of the pile 24 by irregularities in the surface of the pile 24, which may be caused by uneven accumulation of marine debris, pitting, corrosion and so forth. That is, the Belleville spring washer stacks 134 allow for an actual suspension system that allows the traction motors 14 to move closer to, or farther away from, the center of pile 24, as circumstances require, while remaining pressed firmly against the pile 24.

Figure 5:
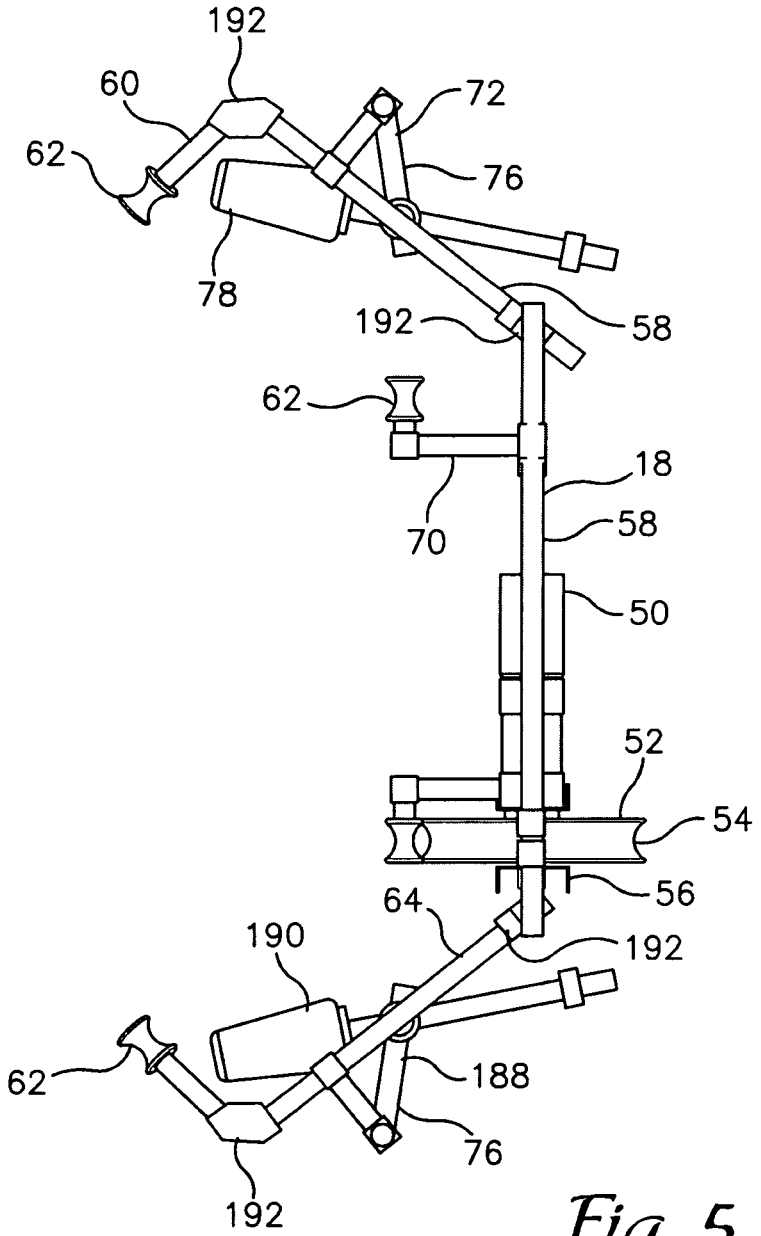
FIG. 5 is a schematic side view of a trolley member that carries one or more water jets or the like and which oscillates about the exterior perimeter of a truss cage of the pile cleaner apparatus of FIG. 1.

Referring to FIG. 5, the side view of the trolley 18 includes the upper water jet nozzle 72 mounted on a top portion of the trolley 18, and a lower water jet mounting bracket 188 and a lower water jet nozzle 190 mounted therein, which is mounted on a bottom portion of the trolley 18. A water jet nozzle or the like may be mounted above the top of the trolley 18, or below the trolley 18, or both at the same time, depending on, for example, the debris load of a particular pile. The angle of any particular water jet 78, 190 relative to a particular pile 24 can be adjusted as desired by toggling the water jet up or down and then tightening the bracket 78, 188. As shown with the knuckle-joints 192, the exact positions of the parts that control the positions of the roller 62 can be readily adjusted into many different positions, which may provide increased traction, strength, and the like. All these arms 60, 64, 70 may be replaced by single members bent or otherwise formed into optimal fixed shapes, which can be made of metal, carbon fiber, and so forth.

While the present invention has been described in accordance with the preferred embodiments thereof, the description is for illustration only and should not be construed as limiting the scope of the invention. Various changes and modifications may be made by those skilled in the art without departing from the spirit and scope of the invention as defined by the following claims.

I claim:

1. A pile cleaning apparatus comprising:

a. a truss cage placed about a pile, said truss cage further comprising a plurality of circular spaced apart concentric ring members with adjacent circular ring members connected to one another by a plurality of struts;

b. means for moving said truss cage up and down a pile mounted on inside surfaces of said ring members;

c. at least one trolley removably mounted on an exterior surface of said truss cage with said at least one trolley having means for engaging said circular spaced apart ring members and means for moving said trolley around said exterior surface of said truss cage; and d. at least one water jet mounted on said trolley and directing water toward the pile outside the height of said truss cage.

2. A pile cleaning apparatus in accordance with claim 1 wherein said truss cage further comprises at least two symmetrical mirror image sections and means for fastening said sections together about to encircle a portion of a pile.

3. A pile cleaning apparatus in accordance with claim 1 wherein said truss cage further comprises four concentric ring members located with a top ring member on a top of said truss cage with a second ring member below said top ring member, a third ring member below said second ring member and a bottom ring member below said third ring member wherein said top ring member and said bottom ring member are of the same diameter and are of a smaller diameter than said second ring member and said third ring member, with said second ring member and said third ring member being adjacent to one another and of the same diameter, whereby rollers mounted on an upper portion of said trolley engage said top ring member and rollers mounted on a lower portion of said trolley engage said bottom ring member and rollers mounted on mid-section portions of said trolley engage said second and third ring members, whereby said ring members serve as tracks that the trolley moves on as it moves around the exterior surface of said cage truss.

4. A pile cleaning apparatus in accordance with claim 1 wherein said means for moving said truss cage up and down a pile further comprises at least one traction motor mounted on the inside of said truss cage.

5. A pile cleaning apparatus in accordance with claim 1 wherein said means for moving said trolley along said truss cage further comprises a drive wheel engaging at least one of a said ring member members of said truss cage and a motor for rotating said drive wheel.

6. A pile cleaning apparatus comprising:

a. a truss cage placed about a pile, said truss cage further comprising a plurality of vertically spaced apart concentric circular ring members with adjacent circular ring members connected to one another by a plurality of struts;

b. at least one traction motor mounted on an inside surface of said truss cage, said traction motor having at least one tread aligned for vertical travel for pressing against a pile whereby said at least one traction motor drives said pile cleaning apparatus up or down along the pile, with said at least one traction motor mounted on a suspension system for pressing said at least one traction motor against the pile and for allowing suspension travel sufficient to accommodate irregularities in the surface of the pile;

c. at least one trolley mounted on an exterior of said truss cage and a motor mounted on said trolley, said motor having a drive wheel engaged with one of said ring members, whereby said motor moves said trolley around an exterior surface of said truss cage; and d. a water jet mounted on said at least one trolley and disposed for directing a water jet to a pile with said water jet projecting outside of the height of said truss cage.

7. A pile cleaning apparatus comprising:

a. a truss cage placed about a pile, wherein said truss cage further comprises at least two symmetrical mirror image sections and means for fastening said sections together about a pile, said truss cage further comprising a top ring member, a second ring member, a third ring member and a bottom ring member, each being circular and concentric and disposed one above the other with said top ring member on top, said second ring member below said top ring member, said third ring member below said second ring member and said bottom ring member below said third ring member and adjacent ring members fastened together by a plurality of struts with said top and bottom ring members being smaller in diameter than said second and third ring members and said second and third ring members having the same diameter;

b. at least three fraction motors mounted on an inside surface of said truss cage, said traction motors having at least one vertically aligned tread each for pressing against the pile whereby said traction motors drive said pile cleaning apparatus up or down along a pile, with each said traction motor mounted on a separate suspension system for pressing said traction motors against the pile and for allowing suspension travel sufficient to accommodate irregularities in the surface of the pile;

c. at least one trolley removably mounted on an exterior of said truss cage, said trolley further comprising a plurality of rollers disposed to grip an inner surface of said top ring member and an inner surface of said bottom ring member and a plurality of rollers disposed to grip an outer surface of said second ring member and a plurality of rollers disposed to grip an outer surface of said third ring member, whereby said rollers on said top ring member and on said bottom ring member resist outward forces created by the thrust of a water jet from at least one water jet nozzle mounted on said trolley and directed at said pile and the rollers disposed to grip said outer surface of said second ring member and said third ring member resist forces directed inward toward the pile and a drive motor mounted on said at least one trolley, said drive motor further comprising a drive wheel connected to said drive motor and engaging an outer surface of a ring member of said truss cage.

* * * * *